US005560120A

United States Patent [19]

Swanson et al.

[11] Patent Number: 5,560,120

[45] Date of Patent: Oct. 1, 1996

[54] LINT HANDLING SYSTEM

[75] Inventors: Edward T. Swanson; Patrick J. Clark, both of St. Joseph; Anthony J. Sajdak, Benton Harbor; Mark R. Jaske, St. Joseph; Johnny W. Zimmerle, St. Joseph; Robert E. Smith, St. Joseph, all of Mich.; Mark H. Nelson, Delaware, Ohio; Raymond M. Goodman; Kevin M. Herreman, both of Stevensville, Mich.

[73] Assignee: Whirlpool Corporation, Benton Harbor, Mich.

[21] Appl. No.: 425,740

[22] Filed: Apr. 20, 1995

[51] Int. Cl.[6] ..... F26B 21/06

[52] U.S. Cl. ..... 34/82; 55/320; 55/332; 34/480

[58] Field of Search ..... 34/82, 480; 55/320, 55/332

[56] References Cited

U.S. PATENT DOCUMENTS

| | | | |
|---|---|---|---|
| 2,802,282 | 8/1957 | Buck . | |
| 2,813,353 | 11/1957 | McMillan . | |
| 2,886,900 | 5/1959 | Flannery . | |
| 3,081,555 | 3/1963 | Stratman . | |
| 3,166,394 | 1/1965 | Lockwood . | |
| 3,639,998 | 2/1972 | Mason . | |
| 3,710,451 | 1/1973 | Buck . | |
| 3,718,982 | 3/1973 | Deaton . | |
| 3,966,441 | 6/1976 | Freze . | |
| 4,294,597 | 10/1981 | Archer et al. | 55/283 |
| 4,314,409 | 2/1982 | Cartier et al. . | |
| 4,421,455 | 12/1983 | Tomren | 415/119 |
| 4,462,170 | 7/1984 | Burkall et al. . | |
| 4,700,492 | 10/1987 | Werner et al. . | |
| 4,889,462 | 12/1989 | Naab et al. . | |
| 5,042,170 | 8/1991 | Hauch et al. . | |
| 5,236,478 | 8/1993 | Lewis et al. | 55/319 |

*Primary Examiner*—Henry A. Bennett
*Assistant Examiner*—Dinnatia Doster
*Attorney, Agent, or Firm*—Hill, Steadman & Simpson

[57] ABSTRACT

An improved lint handling system for a household laundry dryer is provided. The lint handling system for a laundry dryer has a dryer drum with an exit grill. The lint handling system provides a blower speed increaser to increase airflow in the dryer. The lint handling system also has a lint container and a foreign objects trap connected to the exit grill. Also a lint separator to separate lint from the airflow in the dryer is provided. The lint separator has an input connected to the foreign objects trap and an output connected to the lint container. A laundry dryer having a lint handling system as described is also provided. The lint handling system of the invention also provides a scroll-shaped centrifugal blower housing having a cylindrical base to accept airflow tangentially, a cutoff and a throat region to produce high velocity airflow. The blower housing further has a Helmholtz resonator located in the throat to reduce the acoustic emissions at a blade passage frequency. The lint handling system of the present invention also provides an eyebrow extension of the lint separator to produce a low pressure airflow region.

26 Claims, 4 Drawing Sheets

LINT HANDLING SYSTEM

BACKGROUND OF THE INVENTION

The present invention is related to a household laundry dryer and more specifically to a lint handling system for the dryer.

Household laundry dryers are, of course, quite common. In addition, most household laundry dryers have the same basic features and construction. However, different dryers have a variety of convenience features to make the use of the appliance simpler and more convenient to the user. Also, many dryers have certain technical advances that enable more efficient operation of the dryer.

However, one of most common problems with household laundry dryers is the lint handling system of the dryer. In most systems, the user must empty the lint so that the dryer continues to operate efficiently. In many dryers, removal of the lint must be performed after every dryer cycle. Again, this can become tedious and cause inconvenience to a user. As a result, many attempts have been made to improve the lint handling system of a dryer.

For example, U.S. Pat. No. 3,081,555 discloses a lint separator which includes an air swirler to separate lint from the exhaust airflow and a transport tube connected tangentially to the swirler to receive the separated lint and carry it to a storage location. More specifically, this patent has a lint separating system having a centrifugal blower tangentially connected to a separator baffle and cone having a tangential outlet for lint- laden air. The baffle also has an axial outlet to the dryer vent system. The tangential outlet is connected to a lint tube going to a bag housing. This reference however, does not disclose a drawer configuration for the lint reservoir, a foreign objects trap to collect particles other than lint, or an eyebrow baffle within the swirl chamber. This reference also does not disclose a blower speed increaser using pulleys.

Also, U.S. Pat. No. 3,710,451 discloses a centrifugal arrangement for lint separation and incineration. This patent does not disclose a Helmholtz resonator, a foreign objects trap or lint drawer. In addition, U.S. Pat. No. 2,813,353 discloses a swirl chamber upstream of the centrifugal blower, but does not disclose a diffuser, a foreign objects trap, or a Helmholtz resonator. Further, U.S. Pat. No. 2,802,282 discloses a centrifugal lint separator in the dryer door, but does not disclose a diffuser or a Helmholtz resonator.

Thus, a need has arisen for a household laundry dryer that provides an improved lint handling system having both increased efficiency and greater convenience than that presently known.

SUMMARY OF THE INVENTION

Accordingly, the present invention provides a household laundry dryer having an improved lint handling system capable of more efficient operation and greater convenience to a user. A lint handling system for the laundry dryer also includes a Helmholtz resonator to attenuate noise generated in the dryer thereby providing quieter operation.

The present invention also provides a lint handling system having a blower speed increaser. The blower speed increaser provides for more efficient lint handling by providing a bracket hub connected to the dryer motor such that the axes of rotation are parallel, but offset a distance. A set of pulleys are respectively connected to the motor shaft and the blower shaft. A flexible transmission belt connects the pulleys. This apparatus provides greater speed for the blower.

In addition, in an embodiment of the present invention, a foreign objects trap is included to separate out particles other than lint from the airflow. The foreign objects trap has an air travel portion and a baffle wall connected to this housing which separates it from a dryer air intake portion. The intake portion has an exit port for fitting up against the dryer exhaust port. The intake portion of the foreign objects trap has an opening at the bottom thereof for disposing of the particles other than lint.

The lint handling system for a laundry dryer of the present invention also provides an improved lint container having a screened lint containment box with a lid and a drawer to hold the lint until it is disposed of. Also, the lid has a window to provide the user with a visual indication of the amount of lint in the box. An added feature of the present invention is that the drawer is capable of being removed from the lint containment box for easier disposal of the lint. Also, the lint containment box uses a monofilament screen so that the lint is more easily disposed of.

In an embodiment, the laundry dryer having an improved lint handling system of the present invention further provides that the lint container has a lint tray seated within the lint container, a lint transport tube connecting the tangential outlet port of the lint separator to the lint tray and an air re-circulation tube connected to the downstream side of the lint tray to direct air that passes through the lint container back to a region of reentrance into the dryer exhaust.

In addition, the lint separator of the present invention also has a scroll-shaped centrifugal blower housing with a cylindrical base to accept airflow and a cutoff and throat region to produce high velocity airflow. A Helmholtz resonator is located in the throat to reduce the acoustic emission at the blade passage frequency. Also, the blower housing cover has an integral cap member connected to the cylindrical base of the blower housing to form a swirl chamber. The cap member has an annular wall and a tangential outlet through which the separated lint passes. The lint separator also has a stationary diffuser located within the swirl chamber. Also, the lint separator further has an eyebrow extension of the cap member annular wall located at the chamber entrance to produce a low pressure airflow region on the interior surface thereof.

Moreover, the diffuser has a tip with four tapered straightening vanes and a barrel having two curled, streamlining fins. The diffuser also has snap-fit connections to capture the diffuser radially and axially in the blower housing to maintain diffuser-to-housing coaxiality.

It is an object of the present invention to provide an improved laundry dryer having an efficient and convenient lint handling system.

A further object of the present invention is to provide an improved disposable lint collection means for a household laundry dryer.

A further object of the present invention is to provide a lint handling system for a laundry dryer having a Helmholtz resonator to decrease the noise generated by the dryer for quieter operation.

Another object of the present invention is provide a lint handling system that includes a removable lint containment drawer.

Many advantages, features and additional objects of the present invention will become apparent to those skilled in the art upon making reference to the detailed description which follows in the accompanying drawings in which a preferred structural embodiment of a dryer apparatus incorporating the improved features of the present invention is shown by way of illustrative examples.

DETAILED DESCRIPTION OF THE PREFERRED EMBODIMENTS

Figure 1:
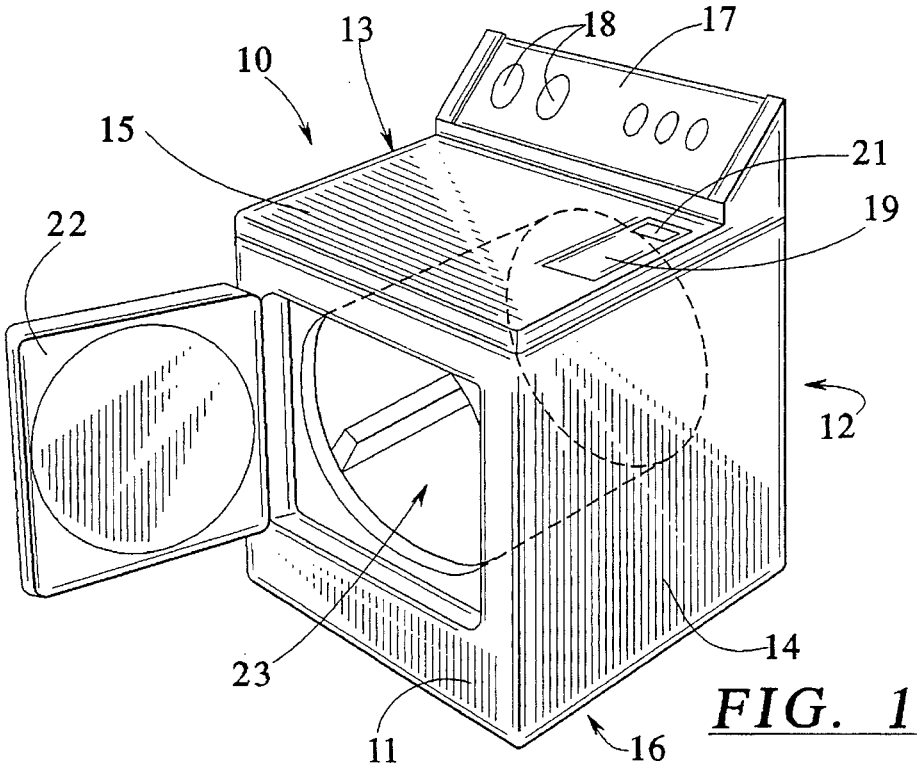
FIG. 1 is a front perspective view of a laundry dryer embodying the principles of the present invention.

In a preferred embodiment of the present invention, an improved lint handling system is provided in a household laundry dryer. Such a household laundry dryer is indicated generally at 10 and comprises a cabinet having a front wall 11, a rear wall 12, sidewalls 13 and 14, a top wall 15 and a bottom wall 16. Mounted at the rear of the top wall 15 is a control panel 17. Also provided are control knobs 18 on the control panel 17 for operating the dryer 10. On one side of the top wall 15 and in front of the control panel 17 is an access lid 19 opening into a lint containment box shown in greater detail in FIG. 4 and identified generally by reference numeral 20. The lid 19 also has a window 21 to provide the user with a visual indication of the amount of lint in the lint containment box 20. The dryer 10 also has a door 22 which provides access to a drum 23 in the interior of the dryer.

Figure 2:
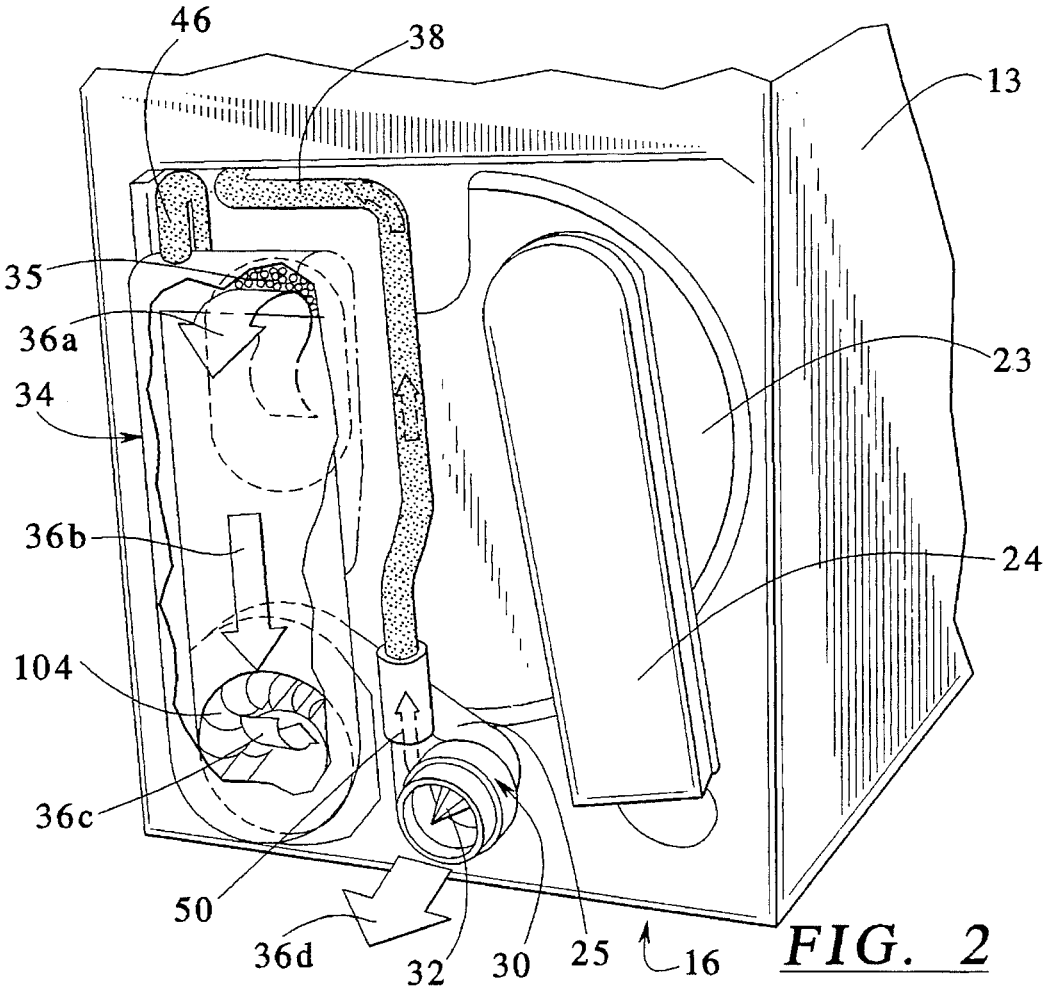
FIG. 2 is a rear perspective view of a laundry dryer, partially broken away, illustrating additional details of an embodiment of the lint separator and foreign objects trap in accordance with the principles of the present invention.

FIG. 2 illustrates, in partial cut-away, the rear wall 12 of the dryer 10. Mounted on the rear wall 12, and communicating with the drum 23 is a heater box 24. The heater box 24 generates heat necessary to dry clothing in the drum 23 of the dryer 10. A blower housing 25 located near the bottom wall 16 of the dryer 10 is also illustrated. The blower housing 25 contains a swirl chamber 76 (FIG. 7) and a lint separator referenced generally at 30. Located within the lint separator 30 is a concentrically disposed diffuser 32. FIG. 2 also illustrates a foreign objects trap 34. The foreign objects trap 34 is connected to a dryer drum air exit grill 35. The lint-laden air passes from the dryer drum 23 through the exit grill 35.

Figure 6:
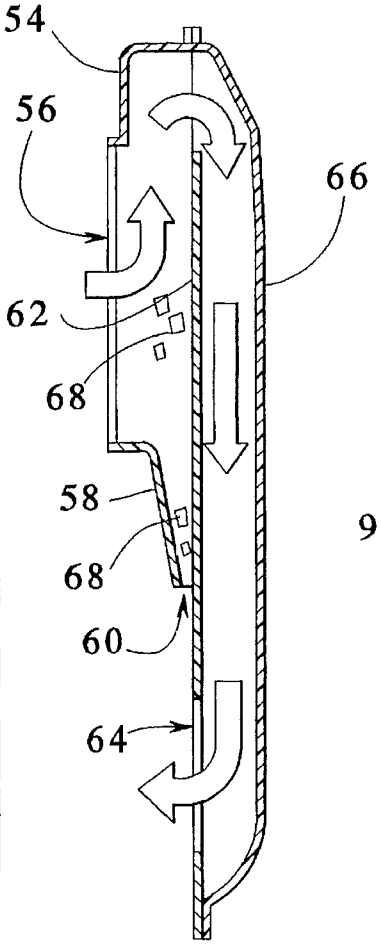
FIG. 6 is a cut-away side view of the foreign objects trap illustrating the airflow pattern of the present invention.

To further describe the basic operation of airflow in the present invention, reference is directed to FIG. 2 and FIG. 6. As shown in FIG. 2, lint-laden dryer air (indicated by an upper arrow 36*a*) passes through the exit grill 35 into the foreign objects trap 34. The lint-laden dryer air continues toward the bottom wall 16 of the dryer 10 as indicated by arrow 36*b*. The air is drawn through the swirl chamber 27 as indicated by arrow 36*c*. The air then finally travels out the lint separator 30. After being separated from the lint-laden air in the lint separator 30, the lint travels up a lint transport tube 38 as indicated by the dashed arrows within the lint transport tube 38. The lint ends its travel path in the lint containment box 20.

Figure 3:
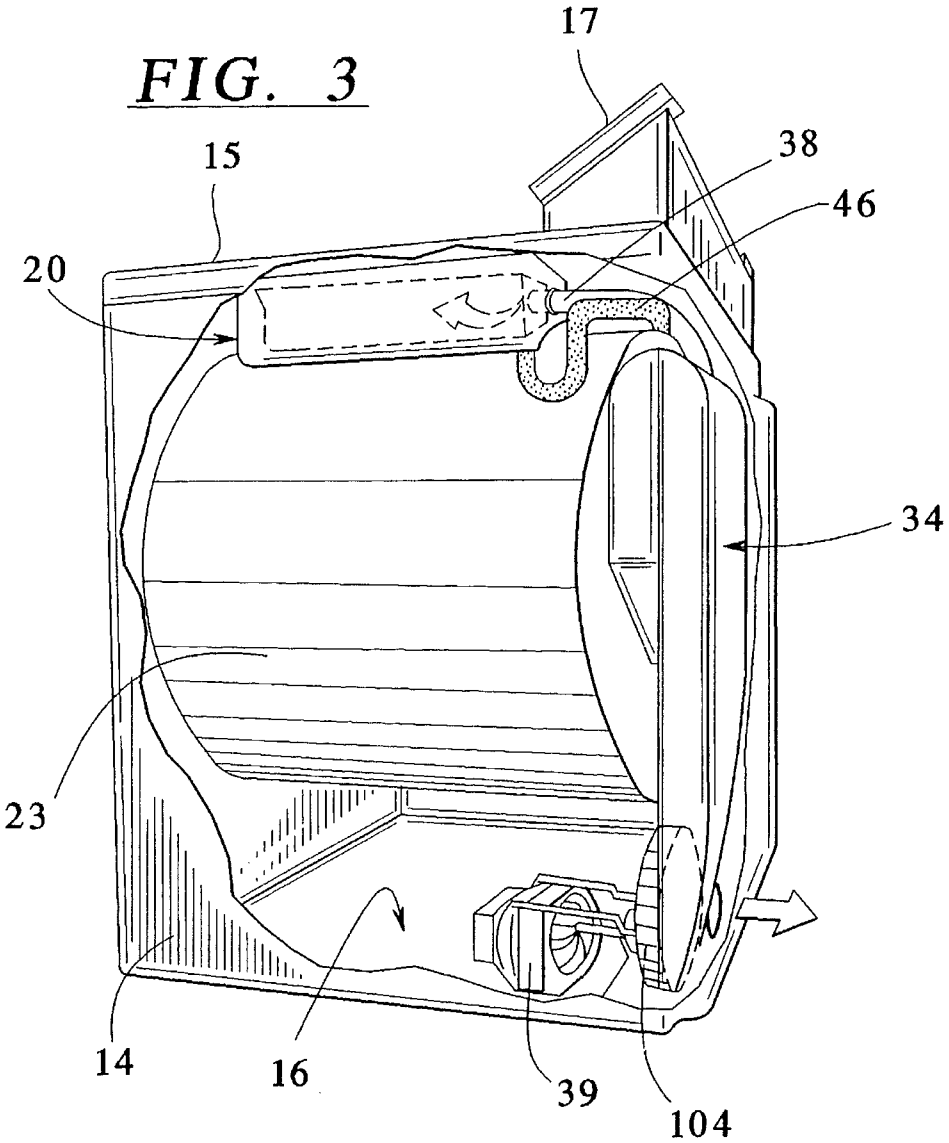
FIG. 3 is a side perspective view, partially broken away, of a laundry dryer embodying the principles of the present invention illustrating the blower speed increaser and the lint containment box of the present invention.

The side perspective view of FIG. 3 further illustrates the laundry dryer 10 having the improved lint handling system of the present invention, wherein like numerals indicate like parts. For example, in addition to the parts illustrated in the prior figures, FIG. 3 shows a dryer motor 39. The dryer motor 39 is further illustrated and described in FIG. 9. Also illustrated in FIG. 3 near the top wall 15 is the lint containment box 20. The lint containment box 20 is further described in detail with reference to FIG. 4.

Figure 4:
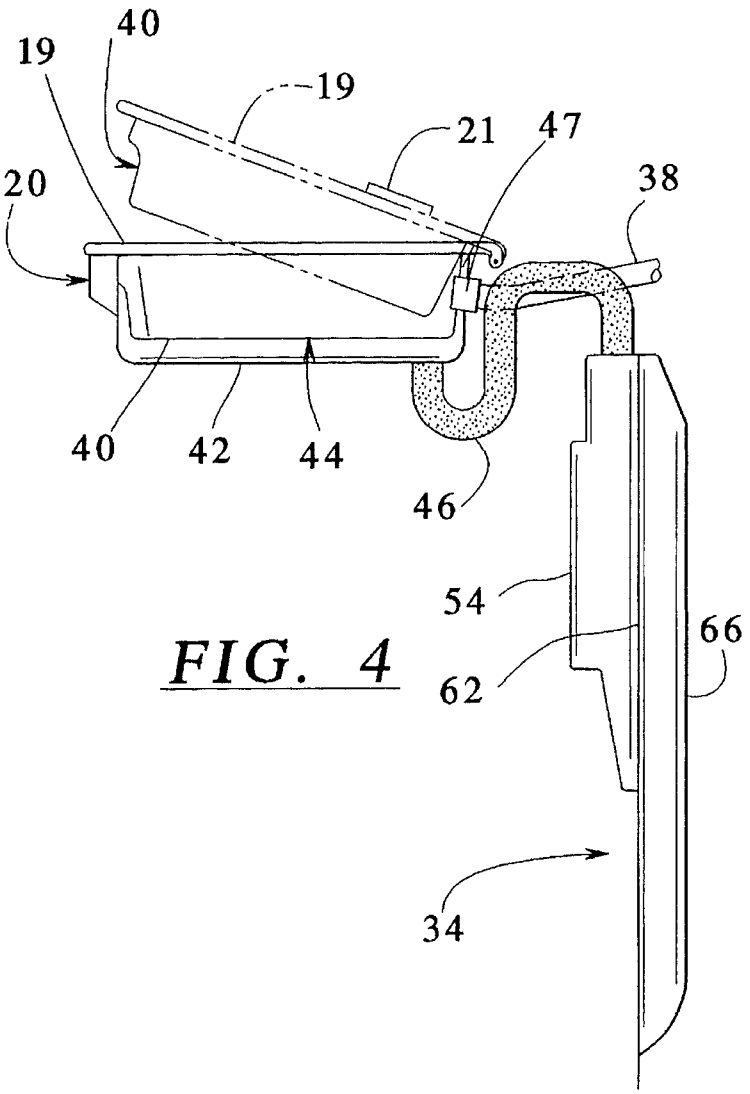
FIG. 4 is a side view of the lint containment box and the foreign objects trap of the present invention.

FIG. 4 illustrates the lint containment box 20 and the foreign objects trap 34 of the present invention and the interconnections therebetween. FIG. 4 illustrates the lint containment box 20 and shows the access lid 19 and a drawer 40. The lint containment box 20 is shown in a closed position and in an open position (shown in dashed lines). As illustrated, the drawer 40 can be removed from the lint containment box 20 to facilitate disposal of the lint. Also shown is the lint transport tube 38 connection into the lint containment box 20. The lint containment box 20 further has a lint tray 42 for housing the drawer 40. The lint tray 42 is slightly deeper than the depth of the drawer 40. This difference in depth provides an air space 44 between the drawer 40 and the bottom of the lint tray 42. This air space is used to facilitate filtered air to flow back to the re-circulate tube 46. The bottom of the tray 42 provides a safety barrier between the user and the dryer drum.

Further shown in FIG. 4 is an air re-circulation tube 46. The re-circulation tube 46 connects to the lint tray 42 by means of a fitting thereon (not shown). Similarly, the lint transport tube 38 connects to the lint tray 42 by an air inlet port fitting 47. The other end of the air re-circulation tube 46 connects to the foreign objects trap 34. The foreign objects trap 34 is further described and illustrated in FIGS. 5 and 6 and discussed below.

As illustrated in FIG. 4, the inlet port fitting 47 directs the separated lint into the screened drawer 40. The drawer 40 of the lint containment box 20 holds a blanket of lint that forms on its interior during the lint separation process. The lid 19 of the containment box 20 features the window 21 that provides the user with a visual indication of when the lint drawer 40 is full and needs emptying. When the drawer 40 is removed from the lint containment box 20, its screened walls retain the lint as the user proceeds in the disposal of the lint. In a preferred embodiment, a monofilament screen is used to allow for easier release of the lint blanket, by means of the user simply turning the drawer 40 upside down, thus eliminating a need for the user to touch the lint.

In addition, the lint transport tube 38 connects to a tangential outlet port 50 on the lint separator 30 (see FIG. 2). Also, the air re-circulation tube 46 is connected on the downstream side of the lint tray 42. The air re-circulation tube 46 directs the air that passes through the lint container box 20 back to a region of re-entrance into the dryer exhaust. In a preferred embodiment, the re-entrance region is at the top of the foreign objects trap 34 as shown in FIG. 4.

Figure 5:
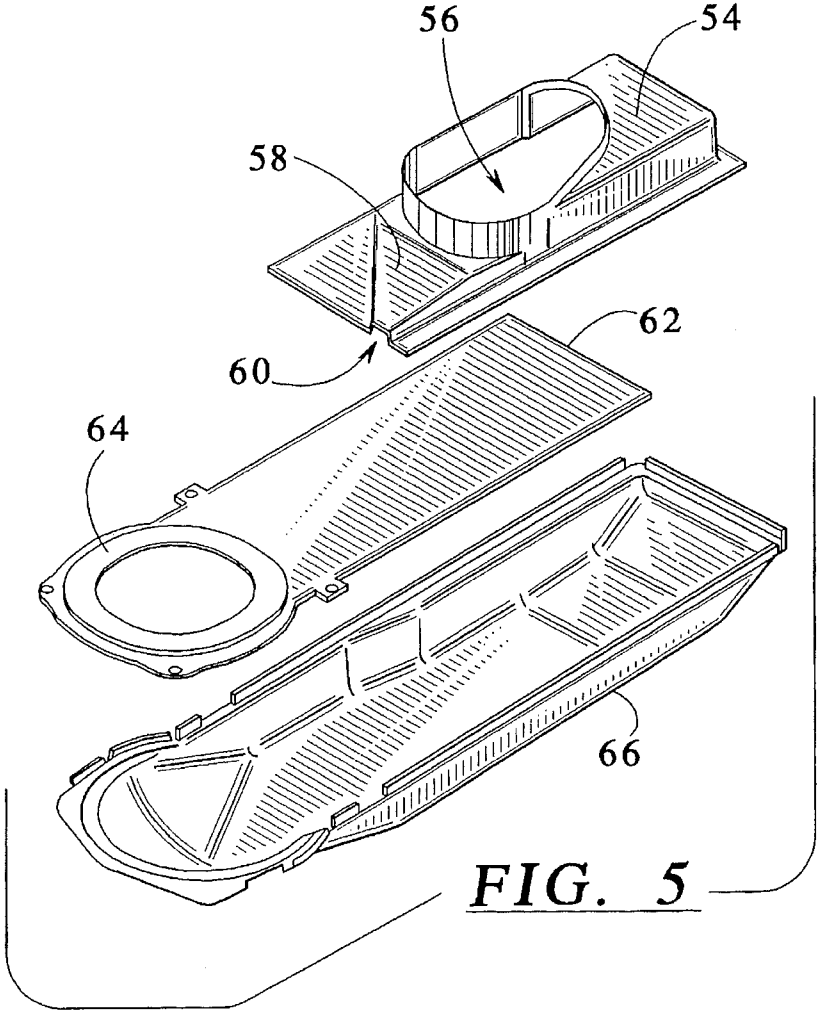
FIG. 5 is an exploded perspective view of the foreign objects trap of the present invention.

The exploded view of the foreign objects trap 34 of FIG. 5 shows in greater detail the interconnections between the components thereof. A description of the foreign objects trap 34 follows. The foreign objects trap 34 comprises three parts. The first part is a dryer air intake portion 54. The dryer air intake portion 54 has an inlet port 56 that coincides in shape and size to the drum air exit grill 35 such that the lint-laden dryer air is transported through the drum air exit grill 35 into the air intake portion 54 of the foreign objects trap 34 via the inlet port 56 thereof. The air intake portion 54 further has a tapered portion 58 that culminates in an opening 60 at the bottom thereof. The purpose of the opening 60 will be described with reference to FIG. 6 below.

The second component of the foreign objects trap 34 is a baffle wall 62. The baffle wall 62 has an exit port 64 near the bottom thereof. The exit port 64 corresponds in size and shape and aligns with the blower housing 25, as further described below with reference to FIG. 7. Thus, the air intake portion 54 and the baffle wall 62 connect to each other and to a third component of the foreign objects trap 34. The third component of the foreign objects trap 34 is an air travel portion 66.

Referring now to FIG. 6, the operation of the foreign objects trap 34 is illustrated and will be described. Lint-laden air from the dryer drum 23, proceeds from the dryer drum 23 through the drum air exit grill 35 into the inlet port 56 of the air intake portion 54. The baffle wall 62 located between the intake portion 54 and the air travel portion 66 is placed in the airstream so that upon exit from the dryer drum 23, objects 68 significantly heavier than air are unable to negotiate the path of air travel over the baffle wall 62. By the force of gravity, such objects 68 will fall to the bottom of the intake portion 54 through the opening 60 so that they may be deposited in a designated area in the bottom wall 16 area of the dryer 10.

Thus, as shown in FIG. 6, the airflow (illustrated by arrows) begins at the inlet port 56 and continues around the baffle wall 62 through the air travel portion 66 and out the exit port 64. As illustrated, the baffle wall 62 has a length less than that of the intake portion 54 and the air travel portion 66 so that the air may pass over the top of the baffle wall 62.

Figures 7, 9:
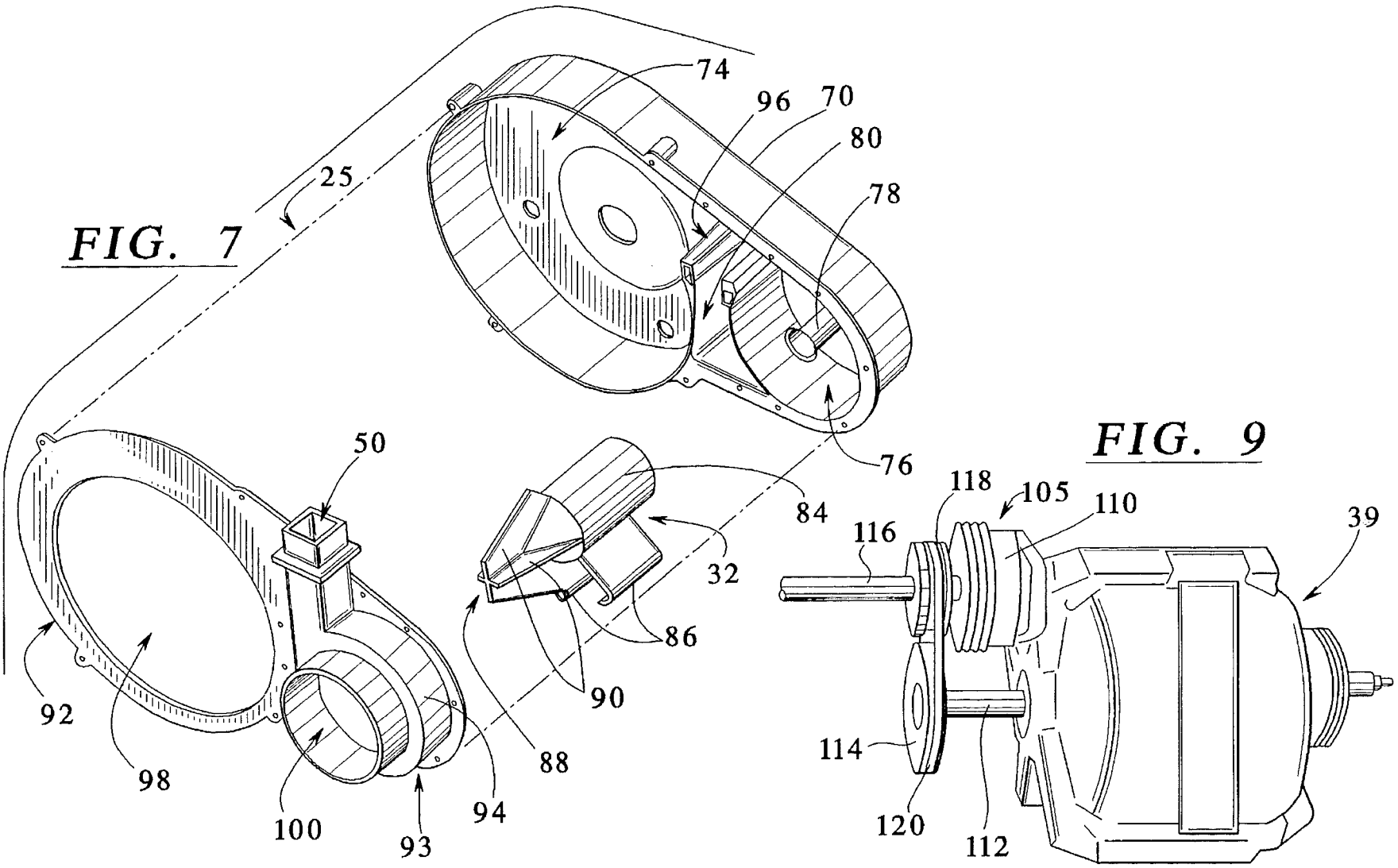
FIG. 7 is an exploded perspective view of the present invention illustrating the blower housing and diffuser.
FIG. 9 is a side view of the dryer motor incorporating the blower speed increaser of the present invention.

The blower housing 25 is shown in an exploded view in FIG. 7. The blower housing 25 consists of three components. The first component is a housing 70 having a scroll-shaped base 74. The housing 70 also has a swirl chamber 76 having a cylindrical base. The swirl chamber 76 has a center post 78 on which the diffuser 32 can be mounted. The housing 70 also has a Helmholtz resonator 80 between the swirl chamber 76 and the cylindrical base 74.

The second component of the blower housing 25 shown in FIG. 7 is the diffuser 32. The diffuser 32 has two functional regions in the embodiment shown in FIG. 7. For example, a barrel 84 having curled fins 86 connected thereto is shown. The curled fins 86 are provided for streamlining the air. The curled fins 86 also serve to accelerate the airstream to improve the centrifugal effect without considerable restriction on the airflow of the system. The diffuser 32 also has a tip 88. The tip 88 has a plurality of tapered, straightening vanes 90. In the embodiment shown, four such vanes 90 are shown. The vanes 90 reduce the swirling pattern contributing to the improvement of the airflow.

The third component of the blower housing 25 is a housing cover 92. The housing cover 92 connects to the housing 70 to form an enclosure. The housing cover 92 also has a cap member 93 with an annular wall 94. When the housing cover 92 is connected to the housing 70, the enclosure formed by the cap member 93 and the housing 70 is the swirl chamber 76. The annular wall 94 further has a throat 96 which connects to the tangential outlet port 50. As the lint-laden exhaust air swirls in the swirl chamber 76, centrifugal force acts upon the lint, which has more mass than the air, and causes it to separate and move outwardly in the swirling air stream. The separated lint passes through the tangential outlet port 50 and travels via the lint transport tube 38 to the lint container 20 as shown in FIGS. 2 and 3. The housing cover 92 also has an air inlet port 98 which connects to the foreign objects trap exit port 64. The housing cover 92 also has an exit port 100 at the end of cap member 93. The diffuser 32 along with the cap member 93 performs lint separation.

Figure 8:
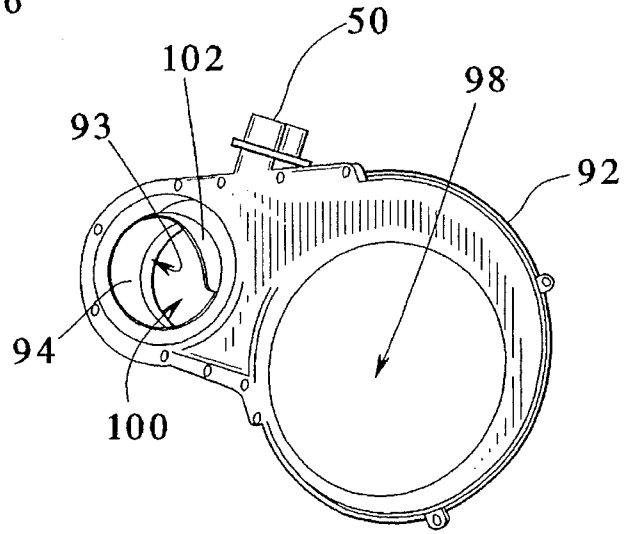
FIG. 8 is a perspective view of the eyebrow baffle of the blower housing of the present invention.

Referring to FIG. 8, the other side of the housing cover 92 is shown. As shown, the annular wall 94 of the cap member 93 has an eyebrow extension 102 positioned at the swirl chamber 76 entrance so that the airflow over this body produces a low pressure region on its interior surface. The presence of the eyebrow extension 102 creates a more favorable pressure gradient in the region near the swirl chamber 76 entrance, thereby allowing the air to maintain a strong swirl pattern. The eyebrow extension 102 also serves to deflect incoming lint that may, due to random motion associated with turbulent flow, be drafted through the exhaust, thus circumventing the separation process.

In a preferred embodiment, the diffuser 32 also incorporates snap-in features which enable the center post 78 to capture the diffuser 32 radially and axially relative to the blower housing 70 to maintain diffuser-to-housing coaxiality, thus improving lint separation efficiency. The purpose of the lint separator 30 is to impart a swirling flow onto incoming air in such a way that the lint particles may be centrifugally extracted from the air stream while still maintaining a desirable level of volume of airflow for dryer venting purposes.

Also, the throat region 96 produces a high velocity of flow with the aid of the housing 70. The housing portion 70 incorporates the lint separator 30 that accepts airflow tangentially. Noise attenuation is accomplished with the custom-tuned Helmholtz resonator chamber 80 located within the throat 96. The Helmholtz resonator 80 is located to reduce the acoustic emission at the blade passage frequency of a blower wheel 104 (see FIG. 2). The resonator 80 is tuned to the same frequency as the blade passage at the cut off and reduces the acoustic emission at that frequency by creating an output that is opposite in phase to the acoustic wave created by the blade passage output. The design of the resonator 80 is such that temperature, pressure and fan speed variations, during normal operation, have a negligible effect on the amount of noise reduction achieved. Thus, the blower housing 25 is capable of pressurizing the lint-laden dryer air and introducing into the swirling flow of the lint separator 30 chamber in a streamlined manner that does not generate unacceptable noise levels.

FIG. 9 illustrates a blower speed increaser generally at 105. The blower speed increaser 105 is capable of driving the blower wheel 104 (see FIG. 2) at a greater speed in order to facilitate lint separation and improve the dryer volume airflow and overall performance. The blower speed increaser 105 has an integral bracket hub 110 connected to the dryer motor 39. The motor 39 has a shaft 112 and a pulley 114 connected at an end thereof. Also, the integral bracket hub 110 has a blower shaft 116 with a lubricated bearing system attached to the dryer motor 39. The blower shaft 116 also has a pulley 118 connected thereto such that the pulleys 114, 118 can be connected by a flexible transmission belt 120 to provide the appropriate increase in speed (from 1725 to 2450 rpm). As illustrated, the axis of rotation of the blower shaft 116 and the motor shaft 112 are parallel, but offset at a distance to fit the dryer geometry.

As is apparent from the foregoing specification, the invention is susceptible of being embodied with various alterations and modifications which may differ particularly from those that have been described in the specification. It should be understood that we wish to embody within the scope of the patent warranted hereon, all such modifications as reasonably and properly come within the scope of our contribution to the art.

The embodiments of the invention in which an exclusive property or privilege is claimed are therefore defined as follows:

1. A lint handling system for a laundry dryer, having a dryer drum with an air inlet and an exit grill for exhaust air, comprising:

a blower for creating an airflow through the drum between the inlet and exit grill;

a blower speed increaser to increase airflow through the dryer drum;

a lint container;

a foreign objects trap connected to the exit grill;

a lint separator to separate lint from the exhaust air from the dryer, the lint separator having an input connected to the foreign objects trap and having an output connected to the lint container, a scroll-shaped centrifugal blower housing, the housing having a cylindrical base to accept airflow tangentially, a sloped cutoff and a throat region to produce high velocity airflow;

and wherein said scroll-shaped centrifugal blower housing contains a Helmholtz resonator located in the throat to reduce the acoustic emissions at a blade passage frequency.

2. The lint handling system of claim 1, wherein the output of the lint separator further comprises:

a tangential output port.

3. The lint handling system of claim 1, wherein the lint container further comprises:

a lint containment box having a lid and a screened drawer to hold lint until disposal thereof.

4. The lint handling system of claim 3, wherein the lid has a window to provide a visual indication of the amount of lint in the lint container.

5. The lint handling system of claim 3, wherein the drawer is capable of being removed from the lint containment box.

6. The lint handling system of claim 3, wherein the screened drawer includes a monofilament screen.

7. The lint handling system of claim 1, wherein the foreign objects trap further comprises:

an air travel portion;

an imperforate baffle wall connected to the air travel portion, the baffle wall having an exit port near a bottom thereof; and an air intake portion having an inlet port therein and an opening located near a bottom thereof, the air intake portion being connected to the baffle wall and the air travel portion to form a channel for airflow therein.

8. The lint handling system of claim 1, wherein the lint separator further comprises:

a housing cover having an integral cap member connected to the cylindrical base of the blower housing to form a swirl chamber, the cap member having an annular wall and a tangential outlet through which the separated lint can pass; and a stationary diffuser located within the swirl chamber.

9. The lint handling system of claim 8, wherein the diffuser further comprises:

a tip having a plurality of tapered, straightening vanes;

a barrel having at least one curled fin to streamline airflow; and snap-fit connections to capture the diffuser radially and axially in the blower housing to maintain diffuser-to-housing coaxiality.

10. The lint handling system of claim 1, wherein the blower speed increaser further comprises:

a dryer motor having a motor shaft;

an integral bracket hub having a blower shaft attached to the dryer motor such that the axes of rotation of the shafts are parallel, but offset a distance;

a first pulley connected to one end of the motor shaft and a second pulley connected to the blower shaft at an adjacent end to the first pulley; and a flexible transmission belt operatively connecting the first and second pulleys.

11. The lint handling system of claim 10, wherein the integral bracket hub having a blower shaft, further comprises:

a lubricated bearing system.

12. A laundry dryer comprising:

a dryer drum having an air inlet and an exit grill for exhaust air;

a blower having rotating blades for creating an airflow through the drum between the inlet and exit grill;

a lint container comprising a lint containment box having a lid and a screened drawer to hold lint until disposal thereof; and a lint separator to separate lint from the airflow in the dryer, the lint separator having an input communicating with the exit grill, an output connected to the lint container and a scroll-shaped centrifugal blower housing, the housing having a cylindrical base to accept airflow tangentially, a cutoff and a throat region to produce high velocity airflow, and a Helmholtz resonator located in the throat to reduce the acoustic emissions at a blade passage frequency.

13. The laundry dryer of claim 12, wherein the output of the lint separator further comprises:

a tangential output port.

14. The laundry dryer of claim 12, wherein the lint container further comprises:

a blower speed increaser to increase airflow in the dryer.

15. The laundry dryer of claim 14, wherein the lid has a window to provide a visual indication of when the lint container is full.

16. The laundry dryer of claim 14, wherein the drawer is capable of being removed from the lint containment box.

17. The laundry dryer of claim 13, wherein the lint container further comprises:

a lint tray having a first and a second fitting;

a lint transport tube connecting the tangential outlet port of the lint separator to the lint tray using the first fitting; and an air re-circulation tube connected to the second fitting on the downstream side of the lint tray to direct air that passes through the lint container back to a region of re-entrance into the dryer exhaust.

18. The laundry dryer of claim 12, wherein the lint separator further comprises:

a foreign objects trap connected between the exit grill and the lint separator.

19. The laundry dryer of claim 12, wherein the lint separator further comprises:

a housing cover having an integral cap member connected to the cylindrical base of the blower housing to form a swirl chamber, the cap member having an annular wall and a tangential outlet through which the separated lint can pass; and a stationary diffuser located within and the swirl chamber.

20. The laundry dryer of claim 19, wherein the lint separator further comprises:

an eyebrow extension of the cap member annular wall positioned at the swirl chamber entrance to produce a low pressure airflow region on the interior surface thereof.

21. A laundry dryer of claim 19, wherein the diffuser further comprises:

a tip having four tapered, straightening vanes:

a barrel having two curled fins to streamline airflow; and snap-fit connections to capture the diffuser radially and axially in the blower housing to maintain diffuser-to-housing coaxiality.

22. The laundry dryer of claim 18, wherein the foreign objects trap further comprises:

an air travel portion;

a baffle wall connected to the air travel portion, the baffle wall having an exit port near the bottom thereof; and an air intake portion having an inlet port therein and an opening located near the bottom thereof, the air intake portion being connected to the baffle wall and the air travel portion to form a channel for airflow therein.

23. A laundry dryer of claim 14, wherein the blower speed increaser further comprises:

a dryer motor having a motor shaft;

an integral bracket hub having a blower shaft attached to the dryer motor such that the axis of rotation of the shafts are parallel, but offset a distance;

a first pulley connected to one end of the motor shaft and a second pulley connected to the blower shaft at an adjacent end to the first pulley; and a flexible transmission belt operatively connecting the first and second pulley.

24. A laundry dryer comprising:

a dryer drum having an air inlet and an exit grill for exhaust air;

a lint container; and a lint separator to separate lint from the airflow in the dryer, the lint separator having an input connected to the foreign objects trap, an output connected to the lint container, a scroll-shaped centrifugal blower housing, the housing having a cylindrical base to accept airflow tangentially, a cutoff and a throat region to produce high velocity airflow, a housing cover having an integral cap member connected to the cylindrical base of the blower housing to form a swirl chamber, the cap member having an annular wall and a tangential outlet through which the separated lint can pass, a stationary diffuser located within and the swirl chamber and an eyebrow extension of the cap member annular wall positioned at the swirl chamber entrance to produce a low pressure airflow region on the interior surface thereof.

25. A lint handling system for a laundry dryer, having a dryer drum with an air inlet and an exit grill for exhaust air, comprising:

a blower for creating an airflow through the drum between the inlet and exit grill;

a blower speed increaser to increase airflow through the dryer drum;

a foreign objects trap connected to the exit grill;

a lint separator to separate lint from the exhaust air from the dryer, the lint separator having an input connected to the foreign objects trap and having a tangential output; and a lint container including;

a lint tray having a first and a second fitting;

a lint transport tube connecting the tangential outlet port of the lint separator to the lint tray using the first fitting; and an air recirculation tube connected to the second fitting on the downstream side of the lint tray to direct air that passes through the lint container back to a region of re-entrance into the dryer exhaust air.

26. A lint handling system for a laundry dryer, having a dryer drum with an air inlet and an exit grill for exhaust air, comprising:

a blower for creating an airflow through the drum between the inlet and exit grill;

a blower speed increaser to increase airflow through the dryer drum;

a lint container;

a foreign objects trap connected to the exit grill; and a lint separator to separate lint from the exhaust air from the dryer, the lint separator having an input connected to the foreign objects trap and having an output connected to the lint container, the lint separator further including;

a scroll-shaped centrifugal blower housing, the housing having a cylindrical base to accept airflow tangentially, a sloped cutoff and a throat region to produce high velocity airflow;

a housing cover having an integral cap member connected to the cylindrical base of the blower housing to form a swirl chamber, the cap member having an annular wall and a tangential outlet through which the separated lint can pass;

a stationary diffuser located within the swirl chamber; and an eyebrow extension of the cap member annular wall positioned at the swirl chamber entrance to produce a low pressure airflow region on the interior surface thereof.

* * * * *